US006206209B1

(12) United States Patent
Houg-Brown

(10) Patent No.: US 6,206,209 B1
(45) Date of Patent: Mar. 27, 2001

(54) SECURE BELT AND TIE HOLDER DEVICE

(76) Inventor: Jenyce W. Houg-Brown, 14750 Pecos St., Broomfield, CO (US) 80020

( * ) Notice: Subject to any disclaimer, the term of this patent is extended or adjusted under 35 U.S.C. 154(b) by 0 days.

(21) Appl. No.: 09/398,394

(22) Filed: Sep. 17, 1999

Related U.S. Application Data

(60) Provisional application No. 60/101,126, filed on Sep. 21, 1998.

(51) Int. Cl.[7] ..... A47F 7/22
(52) U.S. Cl. ..... 211/85.3
(58) Field of Search ..... 211/85.3, 32, 106.01, 211/89.01, 113, 124

(56) References Cited

U.S. PATENT DOCUMENTS

| | | | | |
|---|---|---|---|---|
| 253,918 | * | 2/1882 | Foster | 211/32 |
| D. 297,284 | | 8/1988 | Campbell . | |
| D. 353,943 | | 1/1995 | Varin . | |
| D. 368,166 | | 3/1996 | Sacks . | |
| D. 382,717 | | 8/1997 | Rolnick et al. . | |
| 1,266,962 | * | 5/1918 | Lawlor | 211/32 |
| 1,418,014 | * | 5/1922 | Nordyke | 211/113 |
| 2,036,761 | * | 4/1936 | Krause | 211/113 |
| 2,209,953 | * | 8/1940 | Youngquist | 211/113 |
| 2,524,396 | * | 10/1950 | Papalexis et al. | 211/89.01 |
| 2,553,710 | * | 5/1951 | Incampo | 211/85.3 |
| 2,633,995 | * | 4/1953 | Edelheit | 211/85.3 |
| 2,940,647 | | 6/1960 | Clement . | |
| 3,028,974 | | 4/1962 | Loeb . | |
| 4,429,797 | | 2/1984 | Collins . | |
| 4,778,088 | | 10/1988 | Miller . | |
| 4,784,276 | * | 11/1988 | Gochanour | 211/113 |
| 4,863,043 | | 9/1989 | Bowen . | |
| 5,515,978 | * | 5/1996 | Moran . | |
| 5,626,268 | | 5/1997 | Kolton et al. . | |
| 5,664,708 | | 9/1997 | Sacks . | |

* cited by examiner

*Primary Examiner*—Alvin Chin-Shue
*Assistant Examiner*—Sarah Purol
(74) *Attorney, Agent, or Firm*—Tipton L. Randall

(57) ABSTRACT

The invention is a belt, tie or scarf holder that hangs from a support and accommodates a number of apparel items. The body of the device is a cylindrical member that hangs from a support by a chain and hook. The cylindrical member contains numerous hook and latch fasteners. The fasteners are attached vertically to the surface of the cylinder. The fasteners are J-shaped with the a latch portion biased to remain pointed at the curved end of the fastener. The latch portion is hinged to move both upwardly and downwardly. The fasteners allow a belt or tie to displace the hinged portion downwardly as the item is hooked on the rigid bottom portion. The fastener also allows the belt or tie to displace the hinged portion upwardly to remove the item from the rigid bottom portion. The cylinder rotates on the chain support for easy access to all items fastened to the hooks.

8 Claims, 5 Drawing Sheets

SECURE BELT AND TIE HOLDER DEVICE

CROSS-REFERENCE TO RELATED APPLICATIONS, IF ANY

This application claims the benefit under 35 U.S.C. §119 (e) of provisional application Ser. No. 60/101,126, filed Sep. 12, 1998. Application Ser. No. 60/101,126 is hereby incorporated by reference.

STATEMENT REGARDING FEDERALLY SPONSORED RESEARCH AND DEVELOPMENT

Not applicable.

REFERENCE TO A MICROFICHE APPENDIX, IF ANY

Not applicable.

BACKGROUND OF THE INVENTION

1. Field of the Invention.

The invention relates to a device for hanging belts, ties, scarfs and the like, and more particularly, to a device that securely holds these items until needed.

2. Background of the Invention

The storage of articles of clothing such as belts, ties, scarfs and the like has always presented a problem. When an individual needs to selected one of these items for wear, it is often difficult to view or access all of the items from which to choose. Various belt or tie hangers are available, but often when viewing or accessing the items, it is difficult to see all the items for selection, or several of the items may fall off the hanger.

Some examples of innovative devices for hanging ties, belts and similar items are disclosed by the following patents. Clement, in U.S. Pat. No. 2,940,647, describes a belt rack made of wire for displaying and storing belts.

Collins, in U.S. Pat. No. 4,429,797, shows a tie caddy that hangs vertically in a closet and can be rotated to a horizontal position to select a tie. Miller, in U.S. Pat. No. 4,778,088, discloses a garment carrier hanger for scarves, mittens and gloves that has both rings and clips.

In U.S. Pat. No. 4,863,043, Bowen shows a tie or belt rack that holds the items at a 30 degree angle to allow for ease in selecting the desired item. Kolton et al., in U.S. Pat. No. 5,626,268, disclose an enhanced retention belt hanger with an insertable end to secure the belt.

Sacks, in U.S. Pat. No. 5,664,708 and Des. No. 368,166, discloses a tie and belt holder with a ring member having multiple rigid arms, the whole ring rotating around a detachable hook member.

Design patents by Campbell (Des. No. 297,284), by Varin (Des. 353,943), and by Rolnick et al. (Des. No. 382,717) show item hangers of various forms that do not resemble the present invention.

U.S. Pat. No. 3,028,974 by Loeb shows an article hanger for a closet rod that has an endless belt mounted on a frame suspended from the rod. The belt has spring clips mounted horizontally to accommodate ties and the like, with the belt movable on the frame to allow articles to be moved around the exterior of device.

Thus, there is an unmet need for a device that will securely hold a number of belts, ties, scarfs and the like, and allow an individual to view all available articles of apparel when making a selection from the hanging articles.

SUMMARY OF THE INVENTION

The invention is a hook and latch device for reversibly retaining items secured thereto. The device comprises a J-shaped planar hook member with vertical leg section and curved foot end section. A latch section is positioned coplanar with the hook member and fastened at a first end to the hook member vertical leg section end opposite the curved foot section. The latch section is sized to allow a second end thereof to move past the curved foot section end opposite the vertical leg section. A biasing means maintains the latch section second end in close proximity to the end of the curved foot section end, and allows reversible displacement of the latch section second end both toward or away from the hook member vertical leg section.

The invention also includes an assembly for reversibly securing a plurality of items for storage and retrieval. The assembly comprises a cylindrical member having a longitudinal axis there through, and having a first and a second end portion and an external longitudinal surface section. Hanging means is rotatably fastened to a first end portion of the cylindrical member. The hanging means is adapted to rotatably suspend the cylindrical member from a support point, with the longitudinal axis of the cylindrical member oriented vertically. A plurality of the above described reversibly securing hook and latch members are fastened to the cylindrical member external longitudinal surface, with the vertical. leg section of the hook and latch members aligned parallel with the cylindrical member longitudinal axis and with the curved foot end section oriented radially and toward the hanging means.

DESCRIPTION OF THE PREFERRED EMBODIMENTS

Nomenclature

10 Hook and Latch Member

20 J-Shaped Planar Hook Member

25 Vertical Leg Section

30 Curved Foot Section

35 Latch Section

40 First End of Latch Section

45 End of Vertical Leg Section Opposite Foot Section

50 Second End of Latch Section

55 End of Curved Foot Section Opposite Vertical Leg Section

60 Biasing Means

65 Spring Biasing Member

70 PinMember

75 Aperture in First End of Latch Section

80 Tabs of Vertical Leg Section

85 Aperture in Latch Section

90 Aperture in Tab

95 Slot in Latch Section

100 Torsion Spring Member

105 Prongs of Torsion Spring Member

110 Vertical Slots in Vertical Leg Section

115 Fastener Apertures in Vertical Leg Section

200 Hanger and Storage Assembly

210 Cylindrical Member

215 First End Section of Cylindrical Member

220 Second End Section of Cylindrical Member

225 Exterior Longitudinal Surface of Cylindrical Member

230 Hanging Means

235 Chain Member

240 Hook Member

Construction

Figure 1:
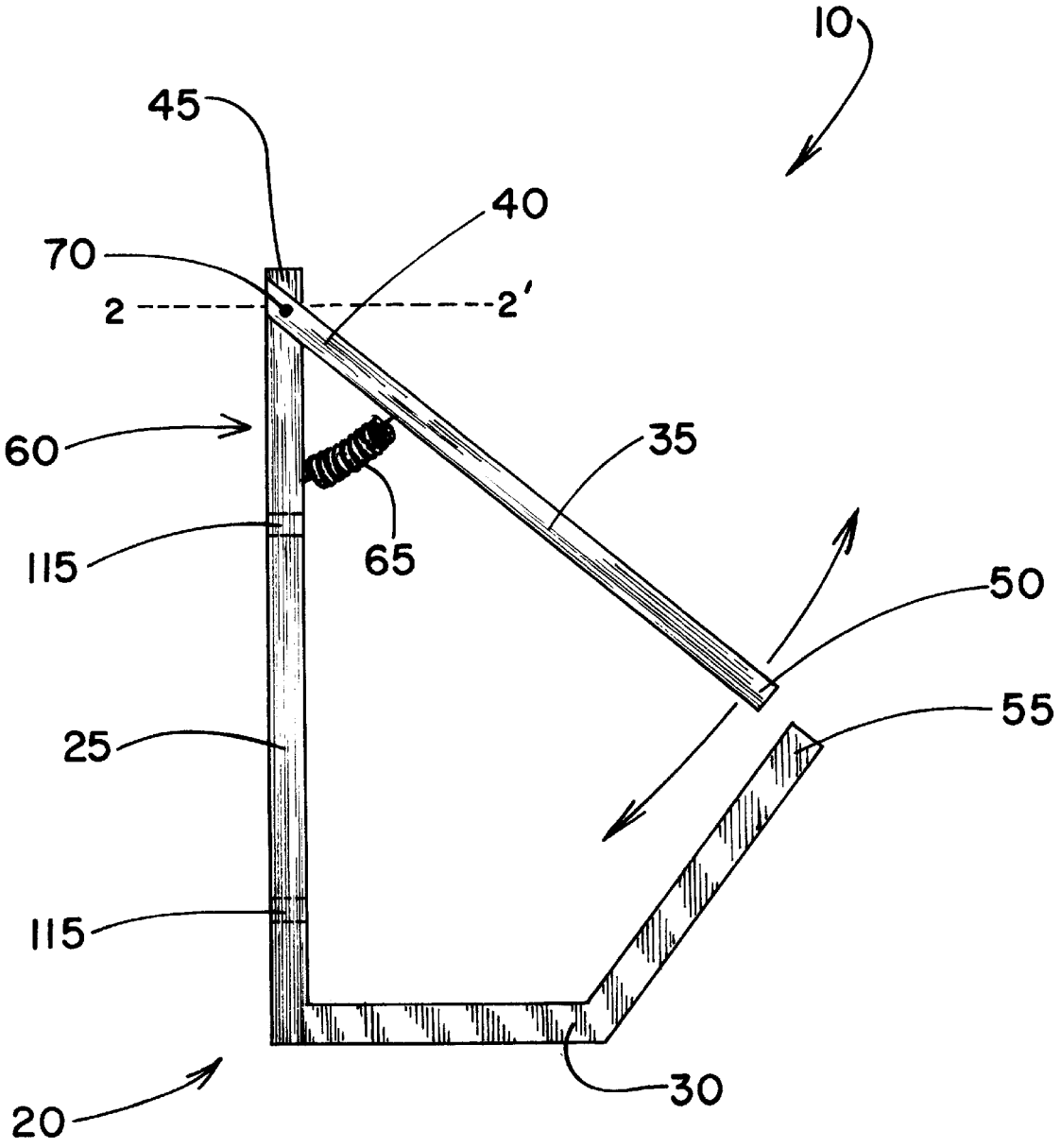
FIG. 1 is a side plan view of one embodiment of the hook and latch member of the present invention.

The invention is a hook and latch member 10 for reversibly retaining items secured thereto. One embodiment of the member 10 is shown in FIG. 1. The member 10 comprises a J-shaped planar hook member 20 with a vertical leg section 25 and a curved foot end section 30. A moveable latch section 35 is positioned coplanar with the hook member 20 and is rotatably fastened at a first end 40 to the hook member vertical leg section end 45 opposite the curved foot section 30. The latch section 35 is sized to allow a second end 50 thereof to move past the curved foot section end 55 opposite the vertical leg section 25. A biasing means 60 allows the latch section 35 to pivot relative to the vertical leg section 25 when pressure is applied thereto, with the biasing means 60 maintaining the latch section end 50 in close proximity to the foot section end 55. The biasing means 60 allows reversible displacement of the latch section second end 55 both toward and away from the vertical leg section 25.

Figure 2:
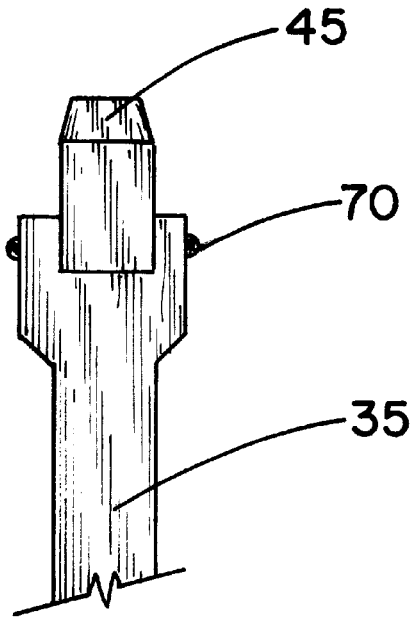
FIG. 2 is a view of the hook and latch member along line 2—2' of FIG. 1.
Figure 3:
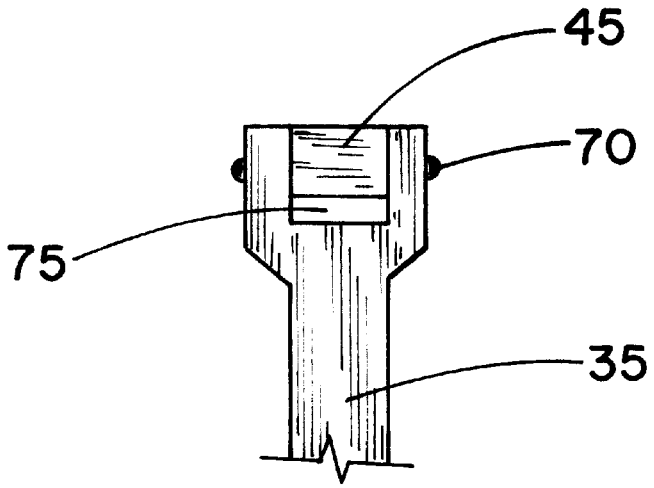
FIG. 3 is a top view of the connection between the vertical leg and latching sections of the hook and latch member.
Figure 5:
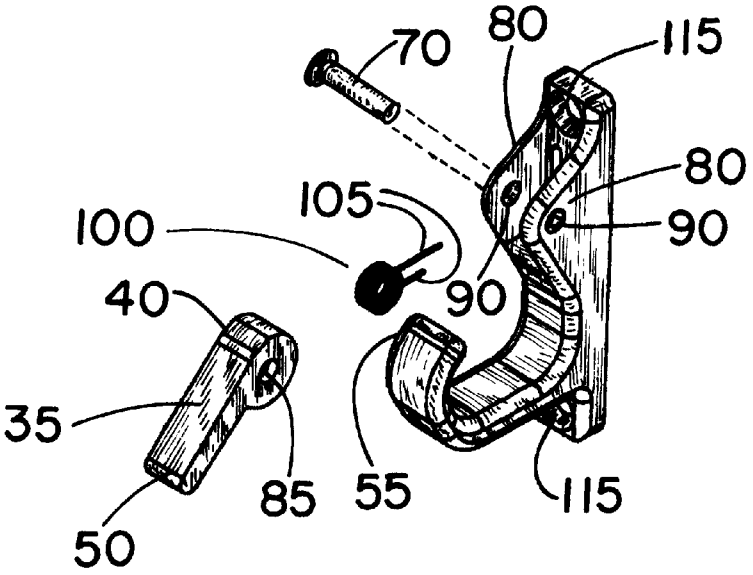
FIG. 5 is an exploded view of the hook and latch member of FIG. 4.

The embodiment of the hook and latch member 10 of FIG. 1 includes a spring biasing member 65 secured between the vertical leg section 25 and the latch section 35. The latch section 35 is fastened at one end 40 to the vertical leg section end 45 by means of a pin member 70, allowing the latch section 35 to pivot both toward and away from the vertical leg member 25. Detailed views of the rotatable fastening between the latch section 35 and the vertical leg member 25 are shown in FIGS. 2 and 3. The latch section first end 40 contains an aperture 75 into which fits the vertical leg member 25. The aperture 75 is sized to allow clearance for the latch section 35 to rotate freely in either direction. The hook and latch member 10 is fastened to a suitable support surface by means of fastening apertures 115 that accept screws entering the support surface.

The spring member 65 is fabricated and sized to hold the latch section end 50 in close proximity to the end 55 of the curved foot section 30. The latching section 35 thus can be pivoted toward the vertical leg section 25 by applying force to the latching section 35, and then hanging an article of apparel on the curved foot section 30. The biasing spring member 65 compresses when pressure is applied, then the spring member 65 expands to normal size to bring the latch section 35 back to the position shown in FIG. 1. This securely maintains the article of apparel on the curved foot section 30.

To remove an article of apparel from the curved foot section 35, pressure is applied to move the latch section 35 away from the curved foot section 35, allowing passage of the article of apparel from the hook device 10. The spring member 65 stretches during opening of the latch section 35, then contracts to the position shown in FIG. 1.

Figure 4:
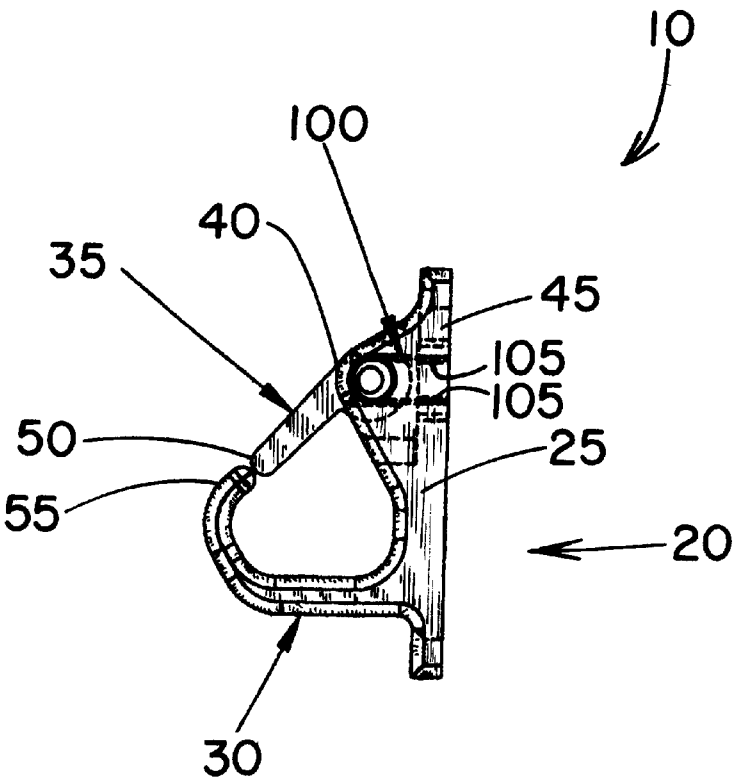
FIG. 4 is a side plan view of another embodiment of the hook and latch member of the present invention.
Figure 7:
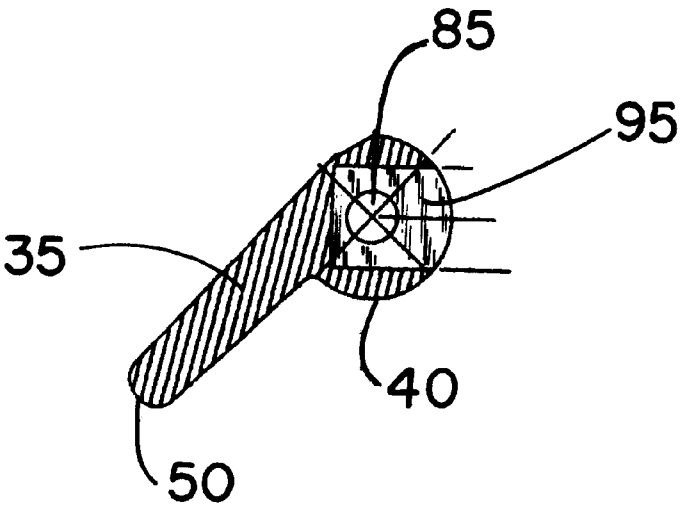
FIG. 7 is a cross sectional view of the latch section of the hook and latch member of FIG. 4.
Figure 6:
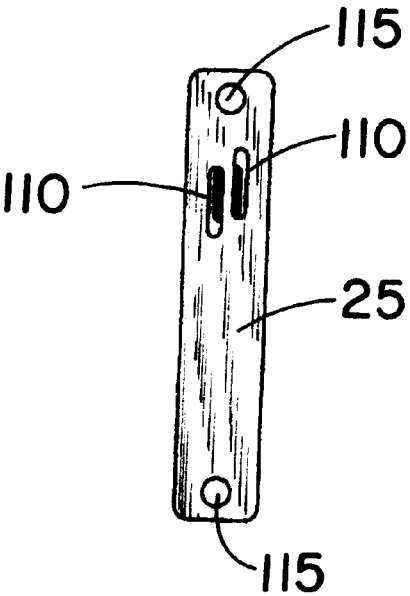
FIG. 6 is a plan view of the rear side of the hook and latch device of FIG. 4.

Another embodiment of the hook and latch member 10 is seen in FIGS. 4–7. The elements in common with FIGS. 1–3 are given the same number in these Figures. The member 10 comprises a J-shaped planar hook member 20 with a vertical leg section 25 and a curved foot end section 30. A moveable latch section 35 is positioned coplanar with the hook member 20 and is rotatably fastened at a first end 40 to the hook member vertical leg section end 45 opposite the curved foot section 30. The latch section 35 is sized to allow a second end 50 thereof to move past the curved foot section end 55 opposite the vertical leg section 25. A biasing means 60 allows the latch section 35 to pivot relative to the vertical leg section 25 when pressure is applied thereto, with the biasing means 60 maintaining the latch section end 50 in close proximity to the foot section end 55. The biasing means 60 allows reversible displacement of the latch section second end 55 both toward and away from the vertical leg section 25. In this embodiment the latch section first end 40 is enlarged and rounded and fits between a pair of tabs 80 on the end 45 of the vertical leg section 25. An aperture 85 in the enlarged end 40 aligns with an aperture 90 in each tab 80 and the pin member 70 rotatably secures the two sections together. The pin member 70 may alternatively be a bolt, a rivet or a similar fastener. The enlarged end 40 of the latch section 35 also contains a slot 95 as shown in FIG. 7. The slot 95 is generally rectangular and sized to accommodate the biasing means 60, in this embodiment, a torsion spring member 100. The torsion spring member 100 has two prongs 105 each of which fit into individual vertical slots 110 in the vertical leg section 25, adjacent the tabs 80. The spring prongs 105 are designed such that one prong 105 contacts one end of one vertical slot 110, while the other spring prong 105 contacts the opposite end of the other vertical slot 110. The torsion spring member 100 is positioned between the tabs 80 with the spring prongs 105 in each slot 110. The latch section 35 enlarged end slot 95 fits over the torsion spring member 100, with the pin member 70 inserted through the apertures 85, 90 and the center of the torsion spring member 100, thereby holding all components in position and at the desired orientation. Thus, the latch section 35 can be rotated either toward or away from the vertical leg section 25 with the torsion spring member 100 biasing the latch section 35 into close proximity with the foot section end 55, as seen in FIG. 4. The vertical leg section 25 also contains a pair of apertures 115 for fastening the hook and latch member 10 to a support member for use.

Other biasing means and methods of pivotally connecting the latch section 35 to the vertical leg section 25, as shown in FIGS. 1–7, are envisioned for the hook and latch member 10.

Figure 9:
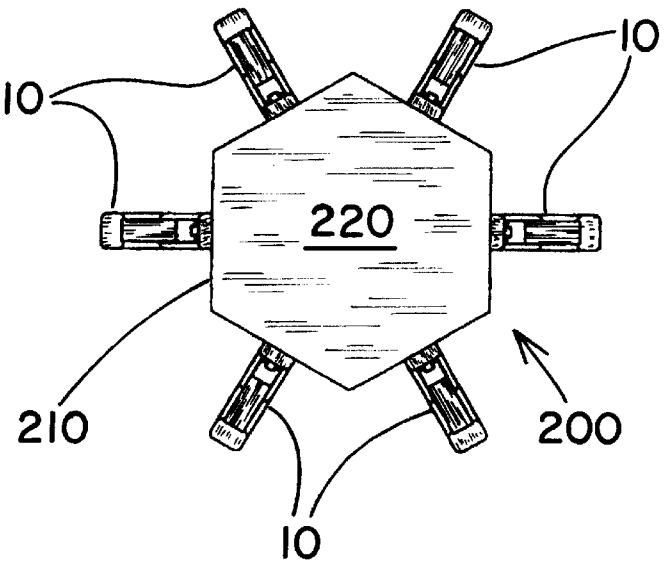
FIG. 9 is a bottom view of the storage assembly of FIG. 8.
Figure 8:
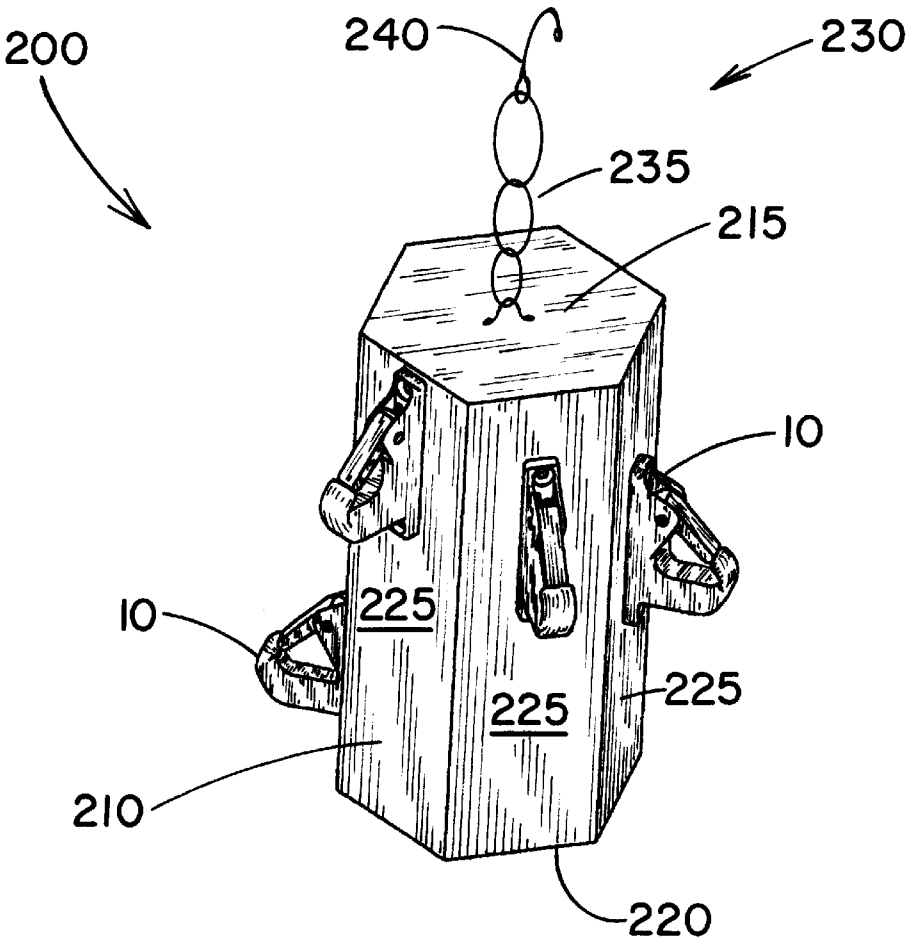
FIG. 8 is a perspective view of the storage assembly used for storing and viewing articles of apparel.

The invention also includes an assembly 200 for reversibly securing a plurality of items for storage and retrieval, as shown in FIGS. 8 and 9. The assembly 200 comprises a cylindrical member 210 having a longitudinal axis there through. The cylindrical member 210 has a first end portion 215 and a second end portion 220 and an external longitudinal surface section 225. A hanging means 230 is rotatably fastened to the first end portion 215 of the cylindrical member 210. The hanging means 230 is adapted to rotatably suspend the cylindrical member 210 from a support point, with the longitudinal axis of the cylindrical member 210 oriented vertically. The hanging means 230 of FIG. 8 is a short length of chain links 235 rotatably secure at one end to the cylindrical member first end 215. The opposite end of the chain member 235 contains a simple hook member 240 which can be used to hang the assembly 200 from a support point, such as a closet clothes rod (not shown). A plurality of the above described reversibly securing J-shaped hook and latch members 10 are fastened to the cylindrical member external longitudinal surface 225, with the vertical leg section 25 of each securing device 10 aligned parallel with the cylindrical member longitudinal axis and fastened to the cylindrical member external surface 225. The curved foot sections 30 of the devices 10 are oriented radially about the cylindrical member 210, with the end 55 of the foot section 30 positioned upwardly, toward the hanging means 230. Although the assembly 200 is shown with six hook and latch members 10, greater or lesser numbers of these members can be present in the assembly 200.

The assembly 200 has the capacity to hold a large number of articles of apparel, limited only by the number of J-shaped hook and latch members 10 secured to the surface section 225. The assembly 200 can be rotated such that an individual can view all items available without the articles falling off of the assembly. The articles of apparel include belts, ties, scarves, sashes and similar items.

While the invention has been particularly shown and described with reference to a preferred embodiment thereof, it will be understood by those skilled in the art that various changes in form and details may be made therein without departing from the spirit and scope of the invention.

I claim:

1. A reversibly securing hook and latch member for retaining items thereto comprising;

a) a J-shaped planar hook member having a vertical leg section and curved foot section, b) a rotatable latch section positioned coplanar with said hook member and fastened at a first end to an end of said hook member vertical leg section opposite said curved foot section, said latch section sized to allow a second end thereof to move past an end of said curved foot section opposite said vertical leg section; and c) biasing means between said vertical leg section and said rotatable latch section fastened thereto, for maintaining said latch section second end in close proximity to said end of said curved foot section end, said biasing means comprises a torsion spring member with first and second spring prongs, said torsion spring member contained in a slot in said latch section first end with said first and second spring prongs each positioned in an individual vertical slot in said end of said vertical leg section opposite said curved foot section, said biasing means allowing reversible displacement of said latch section second end both toward or away from said hook member vertical leg section.

2. The device according to claim 1, further comprising means for fastening said hook and latch member to support surface.

3. An assembly for reversibly securing a plurality of items for storage and retrieval comprising;

a) a cylindrical member having a longitudinal axis there through, first and second end portions and an external longitudinal surface section;

b) hanging means rotatably fastened to a first end portion of said cylindrical member, said hanging means adapted to rotatably suspend said cylindrical member from a support point, with said longitudinal axis of said cylindrical member oriented vertically; and c) a plurality of reversibly securing hook and latch members fastened to said cylindrical member external longitudinal surface, said reversibly securing hook and latch members comprising;

i) a J-shaped planar hook member having a vertical leg section and curved foot section;

a rotatable latch section positioned coplanar with said hook member and fastened at a first end to an end of said hook member vertical leg section opposite said curved hook section, said latch section sized to allow a second end thereof to move past an end of said curved foot section opposite said vertical leg section; and iii) biasing means between said vertical leg section and said rotatable latch section fastened thereto, for maintaining said latch section second end in close proximity to said end of said curved foot section end, said biasing means allowing reversible displacement of said latch section second end both toward or away from said hook member vertical leg section, wherein said vertical leg section of said securing hook and latch member is aligned in parallel with said cylindrical member longitudinal axis and said end of said curved foot end section is oriented toward said hanging means.

4. The device according to claim 3 wherein said biasing means comprises a spring member secured between said vertical leg section and said latching section.

5. The device according to claim 3 wherein said biasing means comprises a torsion spring member with first and second spring prongs, said torsion spring member contained in a slot in said latch section first end with said first and second spring prongs each contained in a vertical slot in said end of said vertical leg section opposite said curved foot section.

6. The device according to claim 3, wherein, said hanging means comprises a chain member fastened at a first end to said first end portion of said cylindrical member, said chain member having a hook member fastened at a second end opposite said cylindrical member.

7. An assembly for reversibly securing a plurality of items for storage and retrieval comprising;

a) a cylindrical member having a longitudinal axis there through, first and second end portions and an external longitudinal surface section;

b) hanging means rotatably fastened to a first end portion of said cylindrical member, said hanging means adapted to rotatably suspend said cylindrical member from a support point, with said longitudinal axis of said cylindrical member oriented vertically; and c) a plurality of reversibly securing hook and latch members fastened to said cylindrical member external longitudinal surface, said reversibly securing hook and latch members comprising;

i) a J-shaped planar hook member having a vertical leg section and curved foot section;

ii) a rotatable latch section positioned coplanar with said hook member and fastened at a first end to an end of said hook member vertical leg section opposite said curved hook section, said latch section sized to allow a second end thereof to move past an end of said curved foot section opposite said vertical leg section; and iii) biasing means between said vertical leg section and said rotatable latch section fastened thereto, for maintaining said latch section second end in close proximity to said end of said curved foot section end, said biasing means comprising a torsion spring member with first and second spring prongs, said torsion spring member contained in a slot in said latch section first end with said first and second spring prongs each contained in a vertical slot in said end of said vertical leg section opposite said curved foot section, said biasing means allowing reversible displacement of said latch section second end both toward or away from said hook member vertical leg section, wherein said vertical leg section of said securing hook and latch member is aligned in parallel with said cylindrical member longitudinal axis and said end of said curved foot end section is oriented toward said hanging means.

8. The device according to claim 7, wherein, said hanging means comprises a chain member fastened at a first end to said first end portion of said cylindrical member, said chain member having a hook member fastened at a second end opposite said cylindrical member.

* * * * *